US007823758B2

(12) United States Patent
Mulderig

(10) Patent No.: US 7,823,758 B2
(45) Date of Patent: Nov. 2, 2010

(54) FOLDING HANGER FOR AT LEAST ONE WATERSPORT GARMENT

(76) Inventor: Michael John Mulderig, 347 H St., Arcata, CA (US) 95521

( * ) Notice: Subject to any disclaimer, the term of this patent is extended or adjusted under 35 U.S.C. 154(b) by 172 days.

(21) Appl. No.: 12/101,928

(22) Filed: Apr. 11, 2008

(65) Prior Publication Data

US 2008/0251548 A1 Oct. 16, 2008

Related U.S. Application Data

(60) Provisional application No. 60/911,234, filed on Apr. 11, 2007.

(51) Int. Cl.
*A41D 27/22* (2006.01)

(52) U.S. Cl. ..... 223/89; 223/88; 223/94; 223/95

(58) Field of Classification Search ..... 223/85, 223/88, 89, 94, 95, DIG. 4
See application file for complete search history.

(56) References Cited

U.S. PATENT DOCUMENTS 2,418,870 A * 4/1947 Crowder ..... 223/89
D171,872 S * 3/1954 Waldron et al. ..... 223/95
2,729,371 A * 1/1956 Waldman ..... 223/89
5,562,237 A * 10/1996 Saliaris ..... 223/95
5,901,888 A * 5/1999 Schneider et al. ..... 223/89
6,036,064 A * 3/2000 Tawil ..... 223/88
7,185,795 B1 * 3/2007 Wallick ..... 223/89

* cited by examiner

*Primary Examiner*—Gary L Welch
*Assistant Examiner*—Nathan E Durham

(57) ABSTRACT

A vee shaped open-armed folding hanger (10) for an improved method of drying and storing watersport garments (20, 22, & 25). Current hangers support all the weight of the garments on the shoulders or shoulder straps causing damage to the garment. This hanger minimizes the stress on a garment (20) by supporting its mid-section from an open horizontal arm (14). By providing two steeply angled arms, bootie posts (12*b*), to hold booties (22) and glove lanyard (24) for gloves (25), all garments are kept on one hanger. When not in use it is folded to conceal the hook, eliminating the potential to inflict damage to a garment when packed together for travel. In the open position, the rotated vee shape provides more vertical reach than other designs; increasing the hanger's versatility. The addition of an auxiliary swivel hook (27) provides even more versatility in suspending the hanger.

14 Claims, 6 Drawing Sheets

FOLDING HANGER FOR AT LEAST ONE WATERSPORT GARMENT

CROSSED REFERENCED TO RELATED APPLICATIONS

This application claims the benefit of PPA EFS ID: 1674987—Application No. 60/911,234 filed 11 Apr. 2007 by "LegalZoom" on behalf the Inventor/Applicant named Michael John Mulderig. The first of the PPA reading as follows: "My invention relates to the drying and storage of water sport garments and accessories, most specifically (though not exclusively), wetsuits and booties."

BACKGROUND OF THE INVENTION

1. Field of Invention

My invention relates to an improved method of drying and storing watersport garments, a group of garments comprising: wetsuits, drysuits, waders, booties, hoods, and gloves.

2. Discussion of Prior Art

Wetsuit manufacturers and suppliers advise buyers not to hang their wet garments by the shoulders. They also caution against using the shoulder method of storage for any substantial period of time. The weight of the suit can permanently damage the often thinner neoprene in the neck and shoulder areas as well as the associated seams. This problem is exacerbated by the extra weight of the water in a wet wetsuit. Similar stress related damage can occur to the latex neck gaskets of drysuits or the suspenders of waders when the entire weight of the garment is transferred to elastic portions of these garments. Currently there are no hangers available to hang watersport garments that use any method other then the shoulder method. U.S. patent application publication US 2006/0226177 A1 to McJunkin (2006) shows how all forms of prior art has addressed this problem by padding or broadening the shoulder support area of the hanger. This method reduces the stress to these areas but can not eliminate it.

Many watersport enthusiasts are reluctant to ignore the manufacturer's recommendations and risk the life of their costly garments by the use of the shoulder method of drying and storing. Faced with no commercially available alternatives, some people resort to draping the suit over whatever rail or bar can be found, often outside, where the suit is subjected to harmful ultraviolet rays. Proper care dictates avoiding the sun's harmful rays. A second method is done by threading their suit thru multiple closed type coat hangers and hanging it wherever the limited reach of the short hook will allow. This method is awkward and the hangers are ill equipped to handle the weight McJunkin's patent application is one of many examples of prior art that uses the broad shoulder design to solve the stress issues. The result is a device that is bulky and not compactly shaped for portability and travel. Working these types of hangers into the neck and shoulders of some of the zipper less wetsuits on the market requires tugging and stretching the neck area. Prior art has the hook always exposed; this provides the potential to damage the garments should the hook snag the garment. Prior art that provided a way of hanging multiple garments and accessories is even more awkward and bulky as can easily be seen in U.S. Pat. No. 5,163,590 Lawler et al (1992). This patent shows a hanger that would be unhandy and inconvenient to travel with.

The open-armed vee shaped hanger has been used often for skirt and trouser hangers; a good example of one is seen in U.S. Pat. No. D171872 Waldron et al (1953). This basic geometry (similar to that of FIG. 1) provides three important features that make it suitable for the field of my invention. The first is ease with which the heavy garment can be positioned on the open horizontal arm. Secondly, the horizontal arm can easily be built to provide an ample supporting area. Lastly, this geometry provides a large vertical reach. The reach is defined by the vertical distance between the point of the hanger's hook and the area that supports the garment. The reach of this is hanger geometry is as much or more than five times that of prior art in the field of watersport garment hangers. This feature opens a multitude of possible places to hang or mount the hanger without additional hardware. The group of such places comprises: overhead support beams and members of porches, garages, lanais; rain gutters and eaves; closet poles, showerheads, and branches; car and truck roof racks; and window casing and doorway trim. Many of these places are beyond the reach of prior art The patent cited in the above paragraph, U.S. Pat. No. D171872 Waldron et al (1953), lacks any way to fold; consequently traveling with the hook end of such a hanger exposed would be inviting damage to your gear. It would also be as awkward to pack for travel as the shoulder supporting hangers.

U.S. Pat. No. 2,686,620 and U.S. Pat. No. 2,729,371 both to Rose Waldman shows a suit coat and trouser hanger that has a folding open arm to hang the trousers from. This feature is attached to the lower part of a conventional looking coat hanger and cannot be used separately. A vee shaped folding hanger designed for supporting "women's purses, handbags, shopping bags or other articles" is shown in U.S. Pat. No. 4,194,714 Schultz (1980). Neither of these patents are in the field of watersport garment hangers.

U.S. Pat. No. 7,219,821 Weal and Weal (2007) shows an example of prior art that uses angled bootie posts to support booties for draining, drying, and storage. Like other inventions they are limited to a single pair of garments (booties in this case) on a single non-folding hanger with limited reach and versatility.

OBJECTS AND ADVANTAGES

The primary object addressed by my invention is to provide an improved method of drying and storing watersport garments and by doing so maximizing their serviceable life. This I accomplished by breaking down the primary object into the following individual objects:

- Minimize stress to the garment while supporting it for drying and storage.
- Provide a way to support multiple garments on one compact hanger.
- Increase the reach of the hanger thereby opening up more suitable places to hang the garment for drying and storage.
- Increase the portability of the hanger and thus insure that my method of proper garment care goes with the watersport person as they travel in pursuit of their sport.
- Encourage proper care of garments and accessories by making a tool for the above objects that is easy, pleasant, and simple to use.
- Achieve the above objects without the use of any electrical components.

My invention satisfies these objects and thus facilitates the use of my improved method of supporting watersport garments. The user will enjoy the benefits of an increased useful life of their watersport garments supported by my hanger.

My invention is the first offer an open-armed vee shaped hanger that allows the weight of a watersport garment to be supported by the comparatively thicker larger midsection of the garment. This area is much more suited to handle the stress without incurring damage. The sectional width of the open arm can be designed to optimize the support that it gives the garment. Supporting the suit in this improved manner will increase the serviceable life of the garment. The open arm allows the garment to be quickly and easily positioned on the hanger without the need to stretch any part of the garment. The lack of stretching, pulling, and poking to get the garment positioned on the hanger will reduce the potential of damage to the fabric. The ease of use will encourage use which will also increase the serviceable life of the garment.

Hanging the garment from the midsection effectively reduces the vertical height needed to suspend the garment. This allows the hanger to be used in more places (e.g. the shell covered back of a pickup truck). Hanging the garment by the midsection also reduces (by 50%) the vertical distance that water must travel to drain out. This hastens the entire drying time and is an important element of my improved method of supporting a watersport garment.

The reach of my invention is as much or more then five times that of prior art. This feature opens a multitude of possible places to hang or mount my invention without additional hardware. The group of such mounts comprises: overhead support beams and members of porches, garages, lanais; rain gutters and eaves; closet poles, showerheads, and branches; car and truck roof racks; and window casing and doorway trim. Many of these places are beyond the reach of prior art. Because my invention is able to hang from a variety of places insures that the garment can be kept sheltered from harmful environmental conditions (e.g. U.V. rays), as it progresses thru the process of draining, drying, and storing.

When not in use my invention folds to a compact, streamlined unit. When folded, the hook nests within the opposing arm so as to virtually eliminate the possibility of snagging the garment. If draining, drying, and storage require different locations, the gear is conveniently kept together during transfers. When it is time to head to the water the garments can be removed from hanger and placed with the folded hanger in a bin or bag without concern.

Portability of the hanger is more than just for the sake of convenience. Common destinations of watersport people generally offer a poor choice of places to drain or dry their garments. The choices might be ragged branches with hidden globs of sap waiting to defile the garment; or a rock or deck rail exposed to the damaging rays of the sun. Traveling with a versatile, compact tool like my invention reduces the risk of such damage resulting in the increased serviceable life of the garment. The open arm vee shape configuration of the hanger allows many possible mounting or hanging sites, thus increasing the user's ability to avoid damaging situations. The folding feature ensures that my improved method of watersport garment care is used in the field as well as at home. Greater use of my method will yield increased serviceable life for costly watersport gear.

Even without a device to support booties, my invention offers a novel solution to the major problems surrounding the care of watersport garments both at home and on the go. The addition of extra garment storage, by integrating the device to support booties into my invention, increases the hanger's utility dramatically. Additional gear can be hung from the hanger by attaching to the hanger a device to support gloves. Items like a separate hood can be slipped over any of the open arms and hung by the chin strap. The above features allow an expansion of my improved method of watersport garment care, bringing efficiency to what becomes "a multi-garment care method". In this way most, if not all, of one's watersport garments would be conveniently drained, dried, and stored in one place on one compact hanger.

The single minor disadvantage of my hanger is that it does not hold the garment open while drying it as the wide shoulder types do. If the garment is to be completely air dried the user is required at some point in time to invert the garment (turn it inside out and visa versa). In the case of wetsuits, they peel off on removal and end up nearly inverted, ready for rinsing. There is a positive side to this disadvantage, namely inverting the garment regularly is a good way to keep in touch with the condition of the garment and address small problems before they become big ones.

The above enumeration of the advantages and disadvantages serves to illustrate how fully my objects were met. Further objects and advantages of my invention will become apparent from a consideration of the drawings and ensuing description.

SUMMARY

My invention is an open-armed vee shaped folding hanger for the drying and storage of at least one watersport garment, a group of garments comprising: wetsuits, drysuits, waders, booties, hoods, and gloves. In its simplest open vee shaped form it has a horizontal arm providing gentle support for the broad midsection of wetsuit, drysuit, or wader. Attached to it by a hinge pin is a raked hook arm with a hook at the end for hanging. The open arm vee shape gives the hanger a uniquely long vertical reach. When folded the hook is out of harms way so it makes a compact traveling hanger that will not snag and damage the garment. A way to support booties, hoods, and gloves can be provided to make a surprisingly versatile and compact multi-garment hanger. The hanger is an important tool for a unique method of watersport garment care, equally adapted to use at home and in the field.

DRAWINGS

Figures

In the drawings and the following description list of hanger 10 and its components are drawn and described as they would appear in the preferred embodiment. The preferred embodiment is drawn and described as if it were fabricated from more components than would be required to machine or mold them. If the later two construction techniques are used then some of the components named below would become integrated features of other components.

FIGS. 1, 2, 3 and 4

Preferred Embodiment

Figure 5:
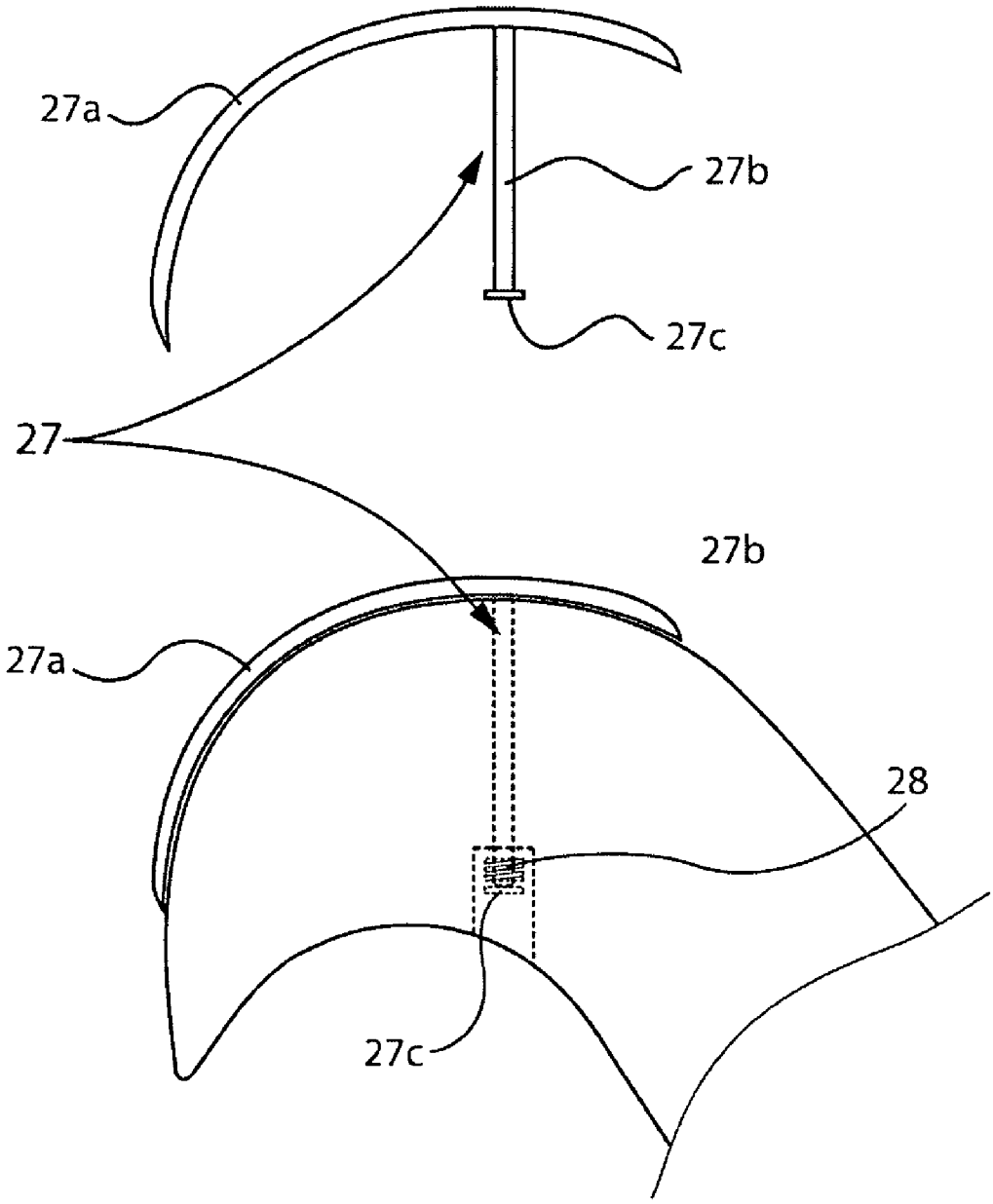
Figure 6:
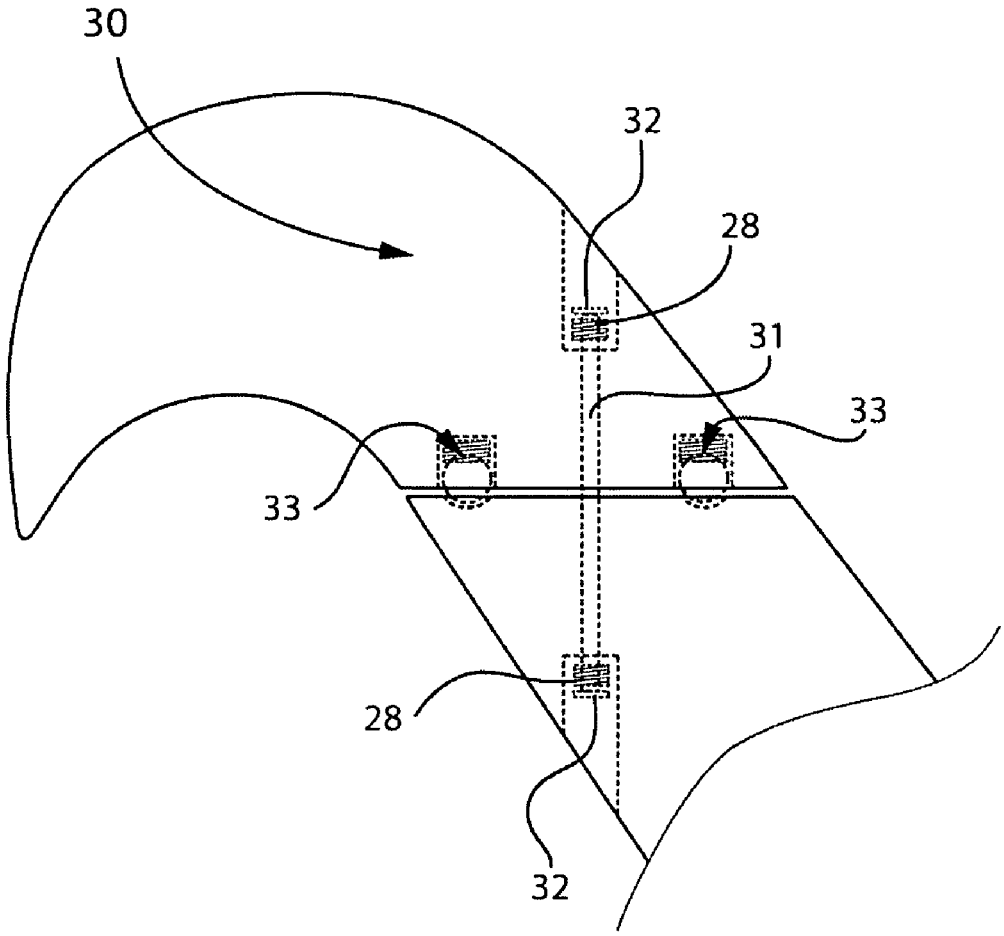

FIGS. 5 and 6

Additional Embodiments

FIG. 5 shows a side elevation of an embodiment of the hook end of raked hook arm 12*a*, detailing auxiliary swivel hook assembly 27.

FIG. 6 shows a side elevation of an embodiment of the hook end of raked hook arm 12*a*, detailing swivel head assembly 30.

Figure 7:
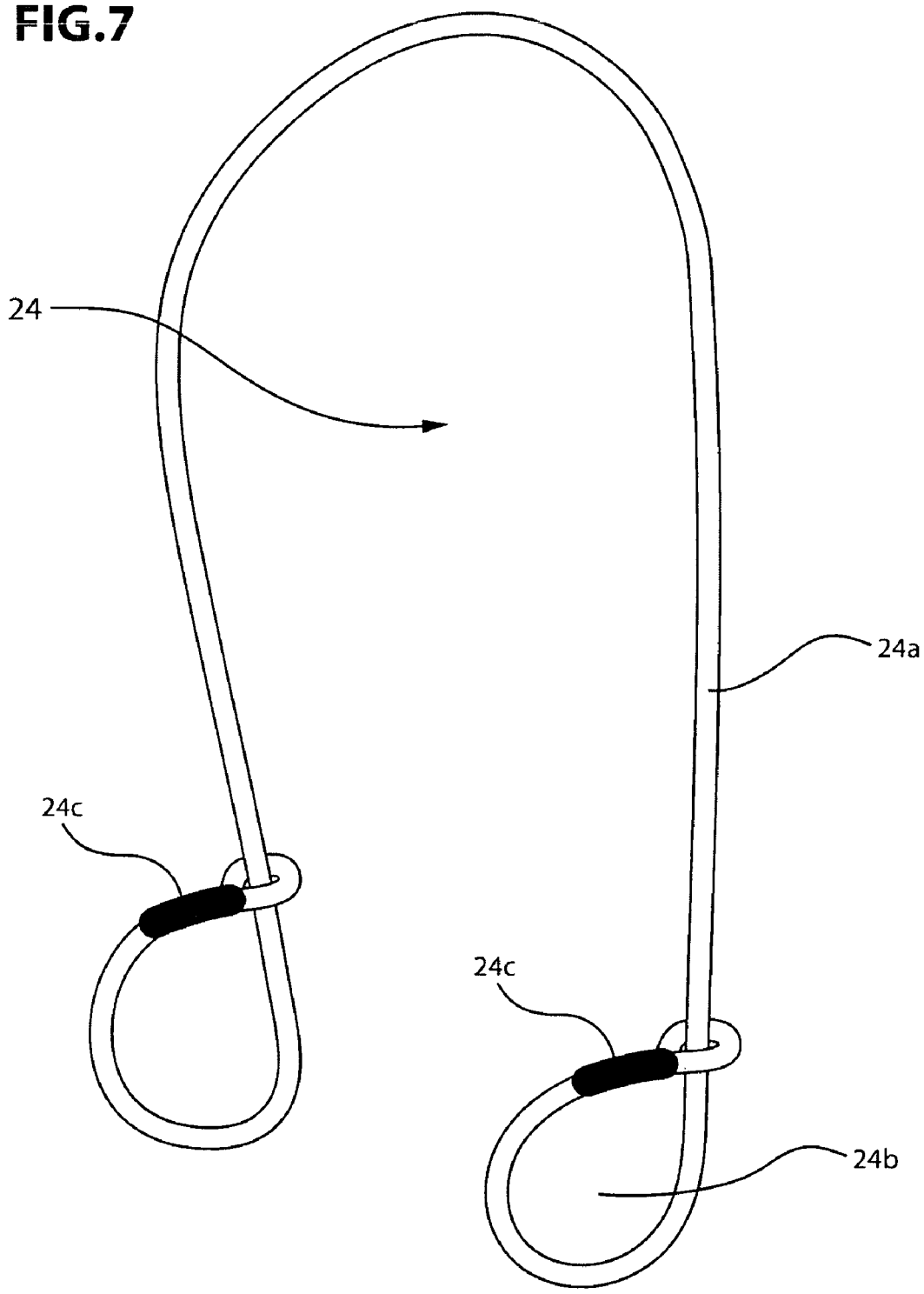

FIG. 7 shows a side elevation of glove lanyard assembly 24.

DRAWINGS

Preferred Embodiment

Reference Numerals

10 open-armed vee shaped folding hanger for multiple watersport garments (hanger)
12 raked hook arm assembly
12*a* raked hook arm
12*b* bootie post
12*c* bootie post attachment dowel
13 rounded chamfers (Not all are noted in the drawings)
14 horizontal arm assembly, comprising components 14*a*, 14*b*, 14*c*, 14*d*, and 14*e*
14*a* horizontal arm
14*b* end spacer block
14*c* fillets (areas built-up or augmented to add width)
14*d* torque bearing plate
14*e* central channel
16*a* hinge pin
16*b* stop pin
18 suitable mount (a surface or place independent of the hanger used to support the hanger from
20 garment (wetsuit in this example)
22 garment (booties in this example)
23 hole
24 glove lanyard assembly, comprising components 24*a*, 24*b*, and 24*c*
24*a* lanyard
24*b* adjustable noose
24*c* crimping ferrule
25 garment (glove in this example)

ADDITIONAL EMBODIMENTS

Reference Numerals

27 auxiliary swivel hook assembly
27*a* swivel hook
27*b* swivel hook vertical axle
27*c* spring retainer
28 coil spring
30 swivel head assembly
31 swivel head vertical axle
32 spring retainer
33 ball catch assembly, comprised of a coil spring, a ball bearing, and a way of retaining the two

DETAILED DESCRIPTION

Preferred Embodiment

In the following description of my invention, hanger 10 and its components are described as if they were fabricated from more components than would be required to machine or mold them. If the latter two construction techniques are used then some of the components named below would become integrated features of other components.

My invention relates to a folding watersport garment(s) hanger. The hanger is comprised of two independent assemblies; a horizontal arm assembly 14 and a raked hook arm assembly 12. They are connected together by a hinge pin 16*a*, a dowel serving as the pivot point of rotation. Hinge pin 16*a* could be considered to be in both or neither assemblies. In the opened position the two assemblies from a vee shape optimum for the intended function. All the components of the hanger could be made form wood, metal, plastic, or any combination thereof. They could be fabricated, machined, molded, or any combination thereof. The components could be glued or mechanically fastened as need dictates.

Horizontal arm assembly 14 is made up of the following components:

In this preferred embodiment a horizontal arm 14*a* is made up of a symmetrical pair of horizontal arms. The arms are connected at the pivot end by torque bearing plate 14*d* and at the opposite end by end spacer block 14*b* forming central channel 14*e* into which raked hook arm 12*a* folds. Horizontal arm 14*a* functions as a cantilevered beam supported from raked hook arm 12*a* by hinge pin 16*a* and the point where the hook arm contacts a torque bearing plate 14*d*. Torque bearing plate 14*d* closes off the hinged end of horizontal arm 14*a* and together with hinge pin 16*a* bears the torque of the cantilever.

On each side of horizontal arm assembly 14, fillets 14*c* are added to increase the surface area for gentler support of the garment. These can be made as one piece or as many smaller sections.

Horizontal arm assembly 14 has fully rounded chamfers 13 on all edges that may come into contact with the garment.

A stop 16*b* is placed in horizontal arm 14*a* to limit the rotation of raked hook arm 12*a* in a closed position. It is placed in such a way as to prevent the taper terminus of the hook end to protrude below the bottom of a central channel 14*e*.

Relative to horizontal arm assembly 14, raked hook arm assembly 12 is raked upwards from where the two assemblies connect at hinge pin 16*a*. Raked hook arm assembly 12 is made up of the following components:

Raked hook arm 12*a* functions as a cantilevered beam supported by horizontal arm 14*a* from hinge pin 16*a* to where it makes contact with the heel (end opposite of the taper terminus) of raked hook arm 12*a*. The hook end serves as the contact or attachment point when hanging or supporting the hanger in service. Contact with a mount (18) is made either at the concave portion of the hook or the end of the taper terminus.

A bootie post 12*b* attaches to each side of raked hook arm 12*a* at hinge pin 16*a* and at a bootie post attachment dowel 12*c*. Each bootie post 12*b* is symmetrically positioned parallel to raked hook arm 12*a* so in the open position they angle upward to support garments in a position that provides for drainage and air circulation.

Bootie post attachment dowel 12*c* serves to attach bootie post 12*b* rigidly to raked hook arm 12*a* (This attachment could be made in a number of ways).

Bootie posts 12*b* and raked hook arm 12*a* have minimally rounded chamfers (not shown on the hook arm) on all edges that could contact the garment. The taper terminus of the hook end has minimal chamfering to insure positive contact where needed.

A hole 23 for a lanyard is located in raked hook arm 12*a*. A glove lanyard 24, with slipknots at its ends, is attached at midpoint to the hanger via hole 23, providing a way for gloves and the like to be supported.

When not in use, raked hook arm assembly 12 folds down parallel to horizontal arm assembly 14, overlapping it, and assuming the closed position. In this preferred embodiment raked hook arm assembly 12 nests into central channel 14*e* to achieve a compact form. When the hanger is in the closed position the taper terminus of raked hook arm 12*a* is housed in central channel 14*e*. This prevents unintentional hooking or snagging of garments.

From the closed position raked hook arm assembly 12 pivots relative to horizontal arm assembly 14 between approximately 25° and 80° to the open position. Horizontal arm assembly 14 remains in a horizontal attitude while raked hook arm assembly 12 articulates upward to form a vee shape. The rotation is limited when the heel of raked hook arm 12*a* (the end opposite the hook) comes in contact with torque bearing plate 14*d* at the pivot end of horizontal arm 14*a*. All the torque of the load placed on horizontal arm 14*a* comes to bear on hinge pin 16*a* and torque bearing plate 14*d*, consequently this area needs to be built to withstand the forces exerted during service.

In the open position, the garment is easily slipped into position over horizontal arm assembly 14 to gently support the garment by the comparatively larger and stronger area of the garment's midsection. In the open position, the vee shape provides a vertical reach of 50 to 70% the length of horizontal arm 14*a* allowing raked hook arm 12*a* access to a multitude of hanging possibilities.

While the present invention has been described in terms of a specific embodiment, it is to be understood that the invention is not limited to these disclosed embodiments. This invention may be embodied in many different forms and should not be construed as limited to the embodiments set forth herein; rather, these embodiments are provided by way of illustration only and so that this disclosure will be thorough, complete and will fully convey the full scope of the invention to those skilled in the art. Indeed, many modifications and other embodiments of the invention will come to mind of those skilled in the art to which this invention pertains, and which are intended to be and are covered by both this disclosure, the drawings and the claims. Furthermore, for purposes of clarity the invention is described in terms of hardware embodiments, but in many ways a particular embodiment is merely a way of facilitating my improved method of watersport garment care.

OPERATION OF INVENTION

FIGS. 1, 2, 3, 4, 7

Figure 1:
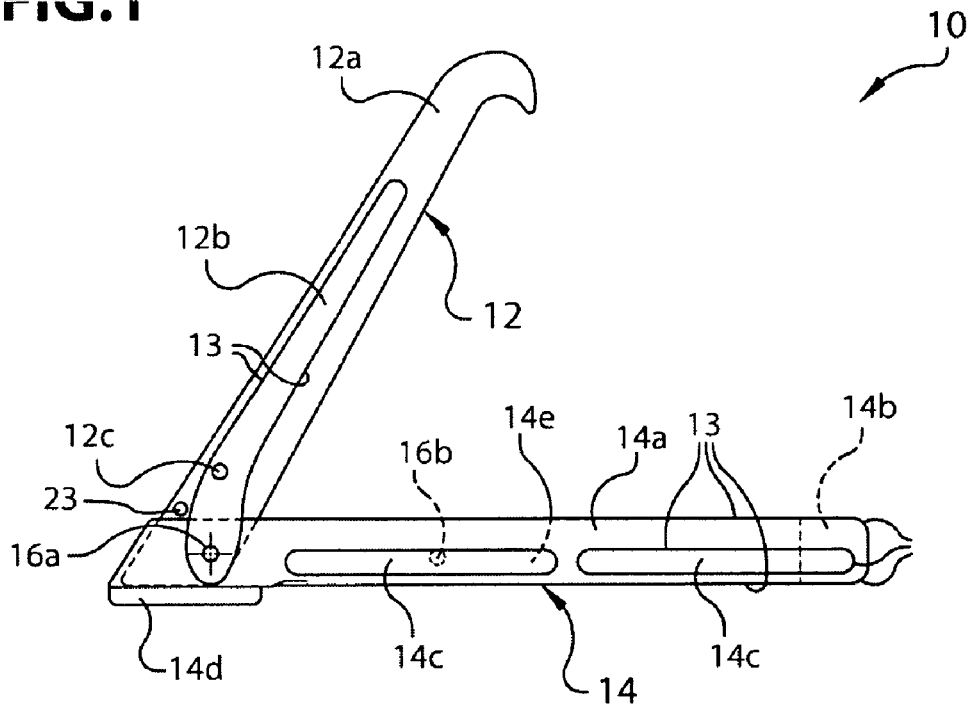
FIG. 1 shows a side elevation view of my invention 10.
Figure 2:
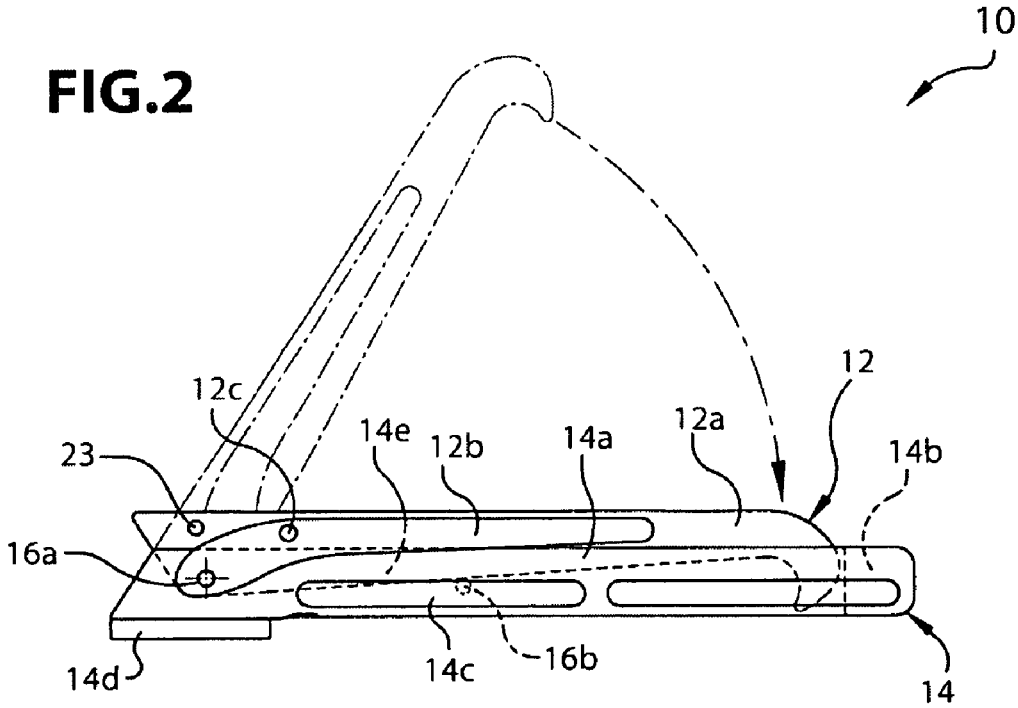
FIG. 2 shows a side elevation view of my invention 10 shown in the folded position.
Figure 3:
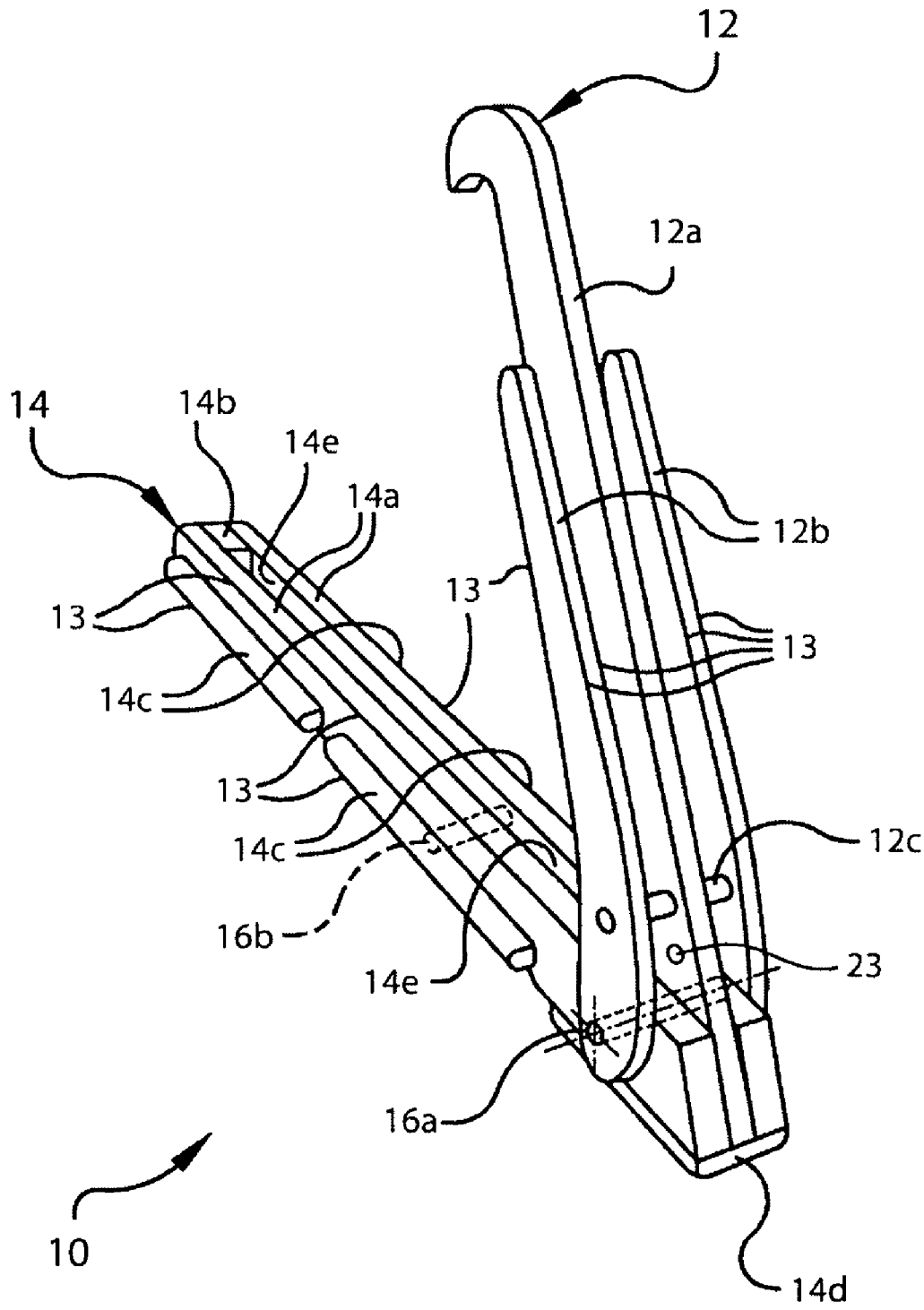
FIG. 3 shows a perspective view of my invention 10 shown from the back or rear view.
Figure 4:
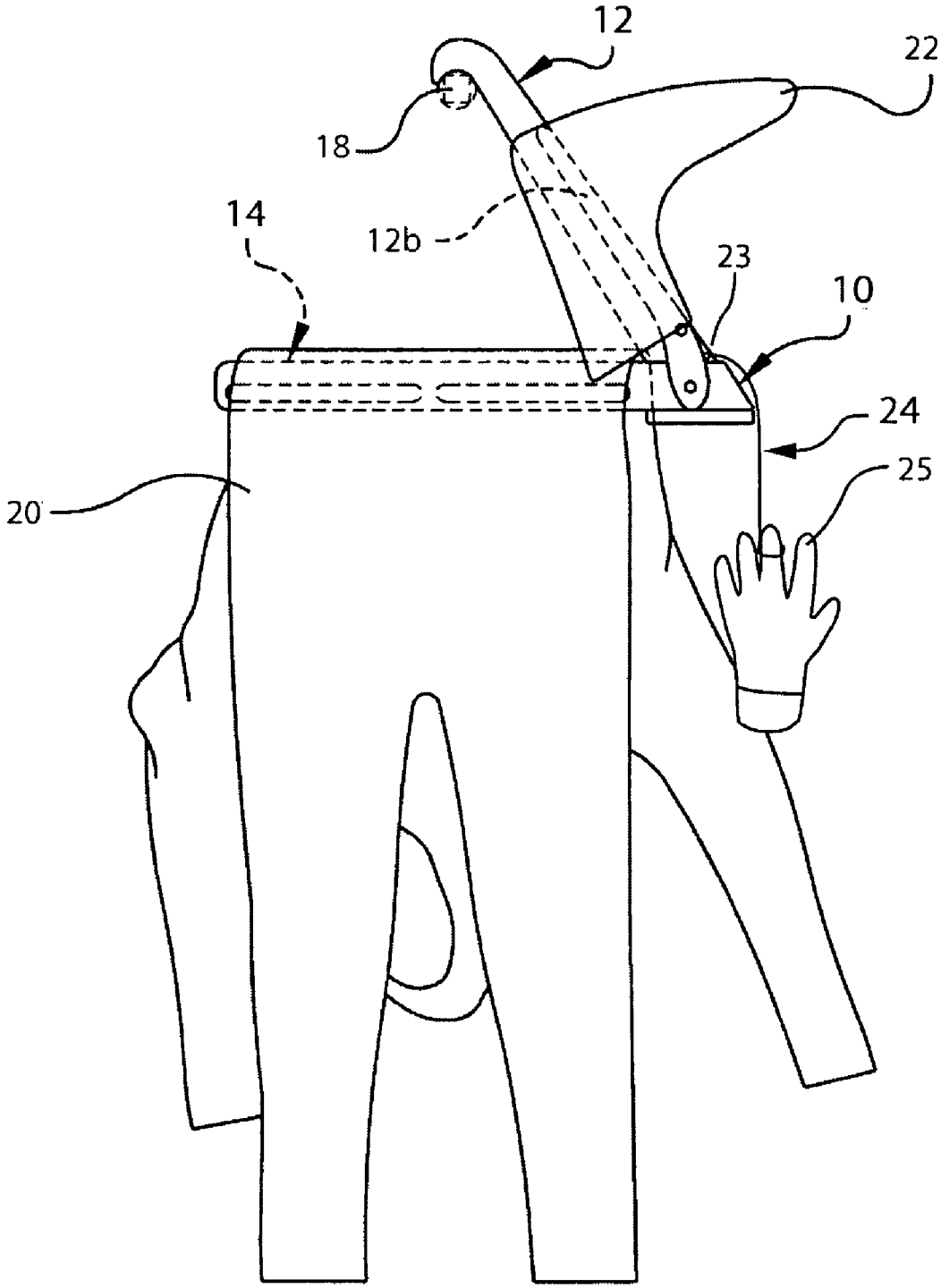
FIG. 4 shows a side elevation view of my invention 10 shown in use with garment 20.

For the purpose of describing the operation of my invention I have used a wetsuit, booties, and gloves; other watersport garments could be substituted. The operation of the preferred embodiment of my invention; as it is intended to be used with my improved method of watersport garment care could be broken down into the following steps:

1. Hanger (10) is placed in the open position (see FIGS. 1 & 2).
2. (see FIG. 4) The midsection of the wetsuit is draped over horizontal arm assembly (14).
3. (see FIG. 4) Each bootie (22) is slipped over one bootie post (12).
4. (see FIG. 7) The middle finger of a glove (25) is inserted into an adjustable noose (24*b*) which is drawn up snugly to securely hold the garment.
5. (see FIG. 4) Hook end of hook arm assembly (12) is hung from (engaged with) a suitable mount (18) for draining and drying
6. If the location of the mount in step 5 is not suitable for drying the garments another mount, in a suitable location is found and put to use.
7. When the exposed surface is dry the wetsuit is removed from the hanger and inverted then step two is repeated.
8. If the location in step 6 is not suitable for storing the garments, another mount, in a suitable location, is found and used.
9. When the time comes to use the garments they are removed from the hanger and placed in a bin or bag to travel with the watersports person wherever the pursuit of her sport might lead.

ADDITIONAL EMBODIMENTS

Illustrated in FIGS. 5 and 6

To further increase the number and type of mounts that could support the hanger, the hook end could be provided with a way of swiveling on a vertical axis (in the open position). This could be accomplished in a number of ways, two of which I have illustrated and will describe below. The basic function would be the same as the preferred embodiment: the hook end serves as the contact or attachment point when engaging a selected mount. Contact is made either at the concave portion of the hook or the end of the taper terminus FIG. 5 shows an auxiliary swivel hook assembly 27 as an addition to the hook end of raked hook arm 12*a*. It would be constructed of a material with qualities to meet the demands of service. As shown a long vertical hole is located in the hook end of raked hook arm 12*a*. The lower end of the hole is countersunk to accept coil spring 28 and a spring retainer 27*c*. The coil spring is placed around a swivel hook vertical axle 27*b* to which spring retainer 27*c* is firmly attached. The opposite end of swivel hook vertical axle 27*b* is securely attached to a swivel hook 27*a*. When in use coil spring 28 applies downward pressure to swivel hook assembly 27 via spring retainer 27*c*. When swiveling the hook is not needed, the compressed spring holds the hook in place in an indentation (not shown) on the top of the raked hook arm. When necessary, swivel hook assembly 27 is pulled upwards and pivoted either direction on swivel hook vertical axle 27*b*. Swivel hook 27*a* could be built single ended or double ended.

FIG. 6 shows a swivel head assembly 30 as a modification of the hook end of raked hook arm 12*a*. As shown, a long vertical hole is located in the hook end of raked hook arm 12*a*. The upper and lower ends of the hole are countersunk to each accept coil spring 28 and a spring retainer 32. The coil springs are placed around each end of a swivel hook vertical axle 31. One spring retainer 32 is firmly attached to each end of the vertical axle. Prior to inserting swivel hook vertical axle 31 into the vertical hole; the hook end of raked hook arm 12*a* is detached (at the neck) on a horizontal plane parallel to the top surface of horizontal arm assembly 14. Prior to reattachment of the hook end with swivel head vertical axle 31 the following operations are preformed: 1) two holes are bored to accept a ball catch assembly 33 in the lower surface of the "head". 2) Corresponding depressions are made in the upper surface of the lower portion of detached raked hook arm 12*a*. When assembled the ball catches and the corresponding depressions retains swivel head assembly 30 in its original attitude. When needed the swivel head is rotated in either direction.

ADDITIONAL EMBODIMENTS

Inferred by Drawings

The following components in various combinations could be eliminated to show simpler embodiments of the invention:

two bootie posts 12*b* together with dowel 12*c* that holds the bootie posts the hook arm fillets 14*c* that are added to the outside of both horizontal arms;

lanyard 24; and hole 23.

Further embodiments of my invention will become apparent from a consideration of the drawings and ensuing description.

My invention can be manufactured from wood, plastic, metal, or any suitable material and or combination along with any suitable fabrication technique such as: machining, molding, gluing, fastening, or any combination. My invention can also be manufactured in different configurations such as an off center hook arm, double hook arms that fold to the outside of the horizontal arm. My invention can also be manufactured in many sizes to accommodate the drying and storing of different items such as rugs, floor mats, coils of rope, etc. and any other item or garment.

ADDITIONAL USES

The hanger could be used singularly or in horizontal series to dry or store other similarly sized objects related or not to watersports. The list of such objects comprises: mats, rugs, and rubber floor mats, coils of rope, garments, surfboards, kayaks, shelving, lengths of hose, pipe, fishing rods, booms, masts, paddles, oars, skis, and poles. If hangers were used in horizontal series the long items in this list could be supported and hung. The hook end of raked hook arm 12*a* of one hanger can be inserted in central channel 14*e* of another and hang from stop pin 16*b*. This surprising feature allows the hangers to be hung in a vertically arranged series. Coupled with the horizontal series this makes for a very portable array for a variety of items and uses

CONCLUSION, RAMIFICATIONS, AND SCOPE OF THE INVENTION

Thus the reader will see that the open-armed vee shaped folding hanger of the invention provides a watersport garment hanger suitable for use with an improved method of watersport garment care. The preferred embodiment of my invention was made public when I introduced it for sale Jul. 12, 2007. Initially, people in the wetsuit industry had difficulty in comprehending the hanger and its method of use. With exposure and education nearly all saw the many advantages my invention has over prior art. A growing number of watersport persons are enthusiastically using the hanger with my improved method of garment care.

While my above description contains much specificity, these should not be construed as limitations on the scope of the invention, but rather as an exemplification of one preferred embodiment thereof. Many other variations are possible. For example:

The hanger could be made with an off-center hook arm.

It could also have a doubled up raked hook arm and fold outside the horizontal arm instead of into a slot.

The simplest embodiment would not include bootie posts 12*b*, fillets 14*c*, and glove lanyard 24. This embodiment would be a single garment folding hanger. It would still offer the basic features needed to take advantage of my improved method of supporting a watersport garment for drying and storing. Other embodiments might combine the above features in different ways.

Bootie post 12*b* could be made to flare outward when the hanger is opened. Bootie posts 12*b* could be shaped so that they mimic the bend at the ankle of a bootie. To maintain the compactness of the folded hanger each bootie post could articulate at the bend and fold.

Bootie posts 12*b* could be attached to the horizontal arm and articulate independently.

Fillets 14*c* could be widened or otherwise shaped to provide a larger support area for a garment. They could be attached in a hinged manner so that when folded up they would nest between each bootie post 12*b* and raked hook arm 12*a*. With this embodiment the fillets would be better described as flaps or folding fins. This would maintain the compactness of the folded hanger. When the hinged fillets were folded down they could provide a larger support area for a garment.

The fillets could be made to slide out away from the hinge pin end of the horizontal arm, increasing the supporting length of the arm. This would open space for wider garments or additional garments.

The open angle formed by the two arm assemblies could be varied to change the qualities of the reach.

Each embodiment could easily be fashioned to provide a way of housing the hook when in the folded position.

Accordingly, the scope of the invention should be determined not by the embodiment(s) illustrated, but by the appended claims and their legal equivalents.

I claim:

1. An open-armed folding hanger used individually or in a series for supporting at least one object selected from a group consisting of mats and oars, comprising:

a. a horizontal arm assembly comprising;

i. a horizontal arm such that the length and width substantially provides a means of bearing said object;

ii. a hole at only one end of said horizontal arm to pivotably accept and engage a hinge pin;

iii. one or more contiguously, slidably, or pivotably mounted fillets providing a means to increase the bearing of said object;

iv. a torque bearing plate providing a means of bearing the torque, about the moment centered at said hinge pin, and created by bearing said at least one object on said horizontal arm assembly when it is in an open position relative to a raked hook arm assembly; and said raked hook arm assembly is engaged with and suspended from a support mount selected from a group consisting of beams and closet poles; and thus providing a means of limiting the articulation of the two said assemblies to a range approximately between 25° and 80° relative to each other;

v. a stop pin located in said horizontal arm assembly providing a means of limiting the articulation of said raked hook arm assembly relative to said horizontal arm assembly when said open-armed folding hanger is in a folded position;

b. said raked hook arm assembly comprising;

i. a raked arm of sufficient length from said hinge pin to an upper supporting end so as to vertically align said upper supporting end with the load bearing center of said horizontal arm assembly when said open-armed folding hanger is in said open position;

ii. a hole at lower end of said raked hook arm to pivotably accept and engage said hinge pin;

iii. the upper end of said raked hook arm shaped to return downward relative to the upward raked length of said raked hook arm and end in a taper terminus thus providing a means of engaging a support mount selected from the group consisting of beams and closet poles;

c. said hinge pin connecting said horizontal arm assembly and said raked hook arm assembly and serving as the fulcrum of rotation that permits the two assemblies to articulate from parallel and overlapping in said folded position to said open position;

whereby when said open-armed folding hanger is engaged with and suspended from said support mount said horizontal arm assembly remains substantially horizontal while supporting the weight of said at least one object selected from the group consisting of mats and oars.

2. The open-armed folding hanger of claim 1 wherein said raked hook arm assembly further includes one or more bootie posts that are attached to said raked hook arm and said hinge pin in such a manner that a substantial portion of said bootie post is cantilevered upward away from said hinge pin providing a means of supporting at least one additional object selected from a group consisting of garments and coils of rope when said open-armed folding hanger is in said open position; whereby two or more objects can be supported from said open-armed folding hanger for drying and or storage.

3. The open-armed folding hanger of claim 1 wherein said horizontal arm assembly further includes a means of housing said taper terminus of said raked hook arm when in said folded position; whereby the hanger becomes compact and less likely to unintentionally engage any objects that it might come in contact with.

4. The open-armed folding hanger of claim 1 wherein the said raked hook arm assembly further includes a plurality of glove lanyard assemblies comprising:

a. a lanyard, the midsection of which is attached to said hinge end of said raked hook arm assembly;

b. slipped loops formed at each end of said lanyard providing a means of attaching an object selected from a group consisting of gloves and hoods at one or all ends of said lanyard;

whereby one or more additional objects selected from the group consisting of gloves and hoods can be drained with their open ends down, dried and stored on said open-armed folding hanger.

5. The open-armed folding hanger of claim 1 wherein said raked hook arm assembly further includes an auxiliary swivel hook assembly comprising;

a. a swivel hook attached in a non-swiveled position above and shaped to parallel said upper supporting end of said raked arm when view in a side elevation;

b. a swivel hook vertical axle providing a means for said swivel hook to rotate at least 90° in each direction from a position parallel to and nested against said upper support end;

c. a means of retaining said swivel hook assembly in said non-swiveled position;

whereby said upper supporting end can engage with and suspend said open-armed folding hanger from one of a multitude of possible support mounts that were not accessible in said non-swiveled position.

6. The open-armed folding hanger of claim 1 wherein said raked hook arm assembly further includes a swivel head assembly comprising;

a. a means of retaining said swivel head assembly in a non-swiveled position;

b. a swivel head vertical axle providing a means of rotating said upper supporting end of said raked arm from said non-swiveled position at least 90° in each direction;

whereby said swivel head assembly can engage with and suspend said open-armed folding hanger from one of a multitude of possible support mounts that were not accessible in said non-swiveled position.

7. The open-armed folding hanger of claim 1 wherein one or more of said open-armed folding hanger are mounted in a parallel horizontal series and spaced at appropriate intervals to provide a means of support for drying or storing objects selected from a group consisting of surfboards and masts.

8. An open-armed folding hanger used individually or in a series for supporting at least one watersport garment comprising:

a. a horizontal arm assembly comprising;

i. a horizontal arm such that the length and width substantially provides a means of bearing said at least one watersport garment;

ii. a hole at only one end of said horizontal arm to pivotably accept and engage a hinge pin;

iii. one or more contiguously, slidably, or pivotably mounted fillets providing a means to increase the bearing of said object;

iv. a torque bearing plate providing a means of bearing the torque, about the moment centered at said hinge pin, and created by bearing said at least one watersport garment on said horizontal arm assembly when it is in an open position relative to a raked hook arm assembly; and said raked hook arm assembly is engaged with and suspended from a support mount selected from a group consisting of beams and closet poles; and thus providing a means of limiting the articulation of the two said assemblies to a range approximately between 25° and 80° relative to each other;

v. a stop pin located in said horizontal arm assembly providing a means of limiting the articulation of said raked hook arm assembly relative to said horizontal arm assembly when said open-armed folding hanger is in a folded position;

b. said raked hook arm assembly comprising:

i. a raked arm of sufficient length from said hinge pin to an upper supporting end so as to vertically align said upper supporting end with the load bearing center of said horizontal arm assembly when said open-armed folding hanger is in said open position;

ii. a hole at lower end of said raked hook arm to pivotably accept and engage said hinge pin;

iii. the upper end of said raked hook arm shaped to return downward relative to the upward raked length of said raked hook arm and end in a taper terminus thus providing a means of engaging a support mount selected from the group consisting of beams and closet poles;

c. said hinge pin connecting said horizontal arm assembly and said raked hook arm assembly and serving as the fulcrum of rotation that permits the two assemblies to articulate from parallel and overlapping in said folded position to said open position;

whereby when said open-armed folding hanger is engaged with and suspended from said support mount, said horizontal arm assembly remains substantially horizontal while supporting the weight of said at least one watersport garment.

9. The open-armed folding hanger of claim 8 wherein said raked hook arm assembly further includes one or more bootie posts that are attached to said raked hook arm and said hinge pin in such a manner that a substantial portion of said bootie post is cantilevered upward away from said hinge pin providing a means of supporting at least one object selected from a group consisting of garments and coils of rope; whereby two or more watersport garments can be supported from said open-armed folding hanger for drying or storage.

10. The open-armed folding hanger of claim 8 wherein said a horizontal arm assembly further includes a means of housing said taper terminus of said raked hook arm when in said folded position; whereby the hanger becomes compact and less likely to unintentionally engage any garments that it might come in contact with.

11. The open-armed folding hanger of claim 8 wherein the said raked hook arm assembly further includes a plurality of glove lanyard assemblies comprising:

a. a lanyard, the midsection of which is attached to said hinge end of said raked hook arm assembly;

b. slipped loops formed at each end of said lanyard providing a means of attaching an object selected from the group consisting of gloves and hoods at one or all ends of said lanyard;

whereby one or more additional objects selected from the group consisting of gloves and hoods can be drained with their open ends down, dried and stored on said open-armed folding hanger.

12. The open-armed folding hanger of claim 8 wherein said raked hook arm assembly further includes an auxiliary swivel hook assembly comprising;

a. a swivel hook attached in a non-swiveled position above and shaped to parallel said upper supporting end of said raked arm when view in a side elevation;

b. a swivel hook vertical axle providing a means for said swivel hook to rotate at least 90° in each direction from a position parallel to and nested against said upper support end;

c. a means of retaining said swivel hook assembly in said non-swiveled position;

whereby said upper supporting end can engage with and suspend said open-armed folding hanger from one of a multitude of possible support mounts that were not accessible in said non-swiveled position.

13. The open-armed folding hanger of claim 8 wherein said raked hook arm assembly further includes a swivel head assembly comprising;

a. a means of retaining said swivel head assembly in a non-swiveled position;

b. a swivel head vertical axle providing a means of rotating said upper supporting end of said raked arm from said non-swiveled position at least 90° in each direction;

whereby said swivel head assembly can engage with and suspend said open-armed folding hanger from one of a multitude of possible support mounts that were not accessible in said non-swiveled position.

14. The open-armed folding hanger of claim 8 wherein one or more of said open-armed folding hanger are mounted in a parallel horizontal series and spaced at appropriate intervals to provide a means of support for drying or storing objects selected from a group consisting of surfboards and masts.

* * * * *